US007186138B2

(12) United States Patent
Wang

(10) Patent No.: US 7,186,138 B2
(45) Date of Patent: Mar. 6, 2007

(54) MULTIPLE PIECES DUAL TYPE BNC CONNECTOR WITH ALL METAL SHELL

(75) Inventor: Shung-Ping Wang, Hsin-Tien (TW)

(73) Assignee: Insert Enterprise Co., Ltd., Taipei Hsien (TW)

( * ) Notice: Subject to any disclaimer, the term of this patent is extended or adjusted under 35 U.S.C. 154(b) by 0 days.

(21) Appl. No.: 11/017,781

(22) Filed: Dec. 22, 2004

(65) Prior Publication Data

US 2006/0134973 A1 Jun. 22, 2006

(51) Int. Cl.
*H01R 13/60* (2006.01)

(52) U.S. Cl. ..... 439/541.5; 439/581

(58) Field of Classification Search ..... 439/540.1, 439/579, 581, 63, 79
See application file for complete search history.

(56) References Cited

U.S. PATENT DOCUMENTS 5,046,952 A * 9/1991 Cohen et al. ..... 439/63
5,088,937 A * 2/1992 Gabany ..... 439/581
5,478,258 A * 12/1995 Wang ..... 439/581
5,613,880 A * 3/1997 Wang ..... 439/620
5,879,166 A * 3/1999 Wang ..... 439/63
6,071,144 A * 6/2000 Tang ..... 439/426
2003/0236027 A1* 12/2003 Wang ..... 439/541.5
2004/0203283 A1* 10/2004 Chen et al. ..... 439/578

* cited by examiner

*Primary Examiner*—Tulsidas C. Patel
*Assistant Examiner*—Vladimir Imas
(74) *Attorney, Agent, or Firm*—Troxell Law Office, PLLC

(57) ABSTRACT

A multiple pieces type dual type BNC connector with all metal shell comprises a rear section casing combined with a plurality of middle section casing, each middle casing is combined with a front section casing; an accepting room formed by the each front section casing, the middle section casing combined therewith and the rear section casing is combined with a insulator, the insulator is combined with a BNC terminal, in which at least one of the rear section casing and the front section casing has a combining groove, at least one of the middle section casing and the front section casing has a combining section, the combining section is engaged in the combining groove.

15 Claims, 14 Drawing Sheets

MULTIPLE PIECES DUAL TYPE BNC CONNECTOR WITH ALL METAL SHELL

BACKGROUND OF THE INVENTION

1. Field of the Invention

The present invention relates to a dual type BNC connector, and more particularly to a dual type BNC connector with an all metal shell.

2. Description of Related Art

The applicant or of the present invention has two patents about electric connectors. One is U.S. Pat. No. 6,676,443 entitled "ALL METAL SHELL BNC ELECTRICAL CONNECTOR". As FIG. 1 shows, a connector has a metal shell 10 with at least a positioning hole 11 disposed therein and a BNC terminal 12 is accepted in each positioning hole 11. A metal cover 13 is attached on the bottom of the shell 10 so that the BNC terminals 12 and the lead wires extended from the rear ends of them are accepted in the space defined by the shell 10 and the metal cover 13. Therefore, the consuming rate of the transmission signal power of the BNC connector can be lowered, the interference resulting from the electromagnetic wave can be reduced so as to enhance the quality of the signal transmission of the BNC connector.

Another patent is U.S. Pat. No. 6,390,840 entitled "AUTO TERMINATION PCB MOUNT CONNECTOR", in which insulators, a spring plate, conductive plate, resistor and metal jacket are installed in a casing. The metal jacket is pressed tightly from the receiving groove of the casing wall toward the inner side of the casing to contact and press the resistor against the conductive plate. A fixing element is associated at the outside of the casing; the connector is caused to be in conjunction with the printed circuit board by inserting the fixing element into a groove in a printed circuit board. The spring plate keeps contacting with the conductive plate in a normal state. The spring plate soon contacts with an inserting end of another connector and is separated from the conductive plate without contacting it if the inserting end of another connector is inserted. When the spring plate and the conductive plate contact with each other, an output signal transmitted to the spring plate can be transmitted back to the ground of the PC plate through the conductive plate, the resistor, the metal jacket, the casing and the fixing element so as to form a close circuit. The components of the connector according to the patent are few and the assembly thereof is easy. It can be inserted onto a PC plate, and the circuit can be allowed to have a better filtering function through the resistor so as to reduce the electromagnetic wave interference problem caused from the signal output from the spring plate and lower the loss of the power output.

SUMMARY OF THE INVENTION

The dual type connector mentioned above has a one-piece type metal casing. As FIG. 2 shows, it is very difficult to manufacture a one-piece type metal casing 14 by means of die-casting forming when there are two or more than two accepting rooms 141 for a dual type BNC terminal. For manufacturing a metal casing with two sets or more than two sets of dual type BNC connectors more easily and in a mass production so as to save the production cost, the present invention is proposed. Besides, as FIG. 1 shows again, the bottom of the metal shell 10 of a BNC connector is combined with a metal cover 13 at the bottom thereof. Generally, a layer of insulating paint is spread at the inner side face of the metal cover 13 to allow an insulating effect existed between the metal cover 13 and lead wires 121. But, the insulting effect is influenced when the spreading of the insulating paint is uneven. For further improving the insulating effect between the metal cover 13 and the lead wires 121, allowing the portion of the lead wire 121 extended outside of the metal shell 10 to be able to be fixed, and being more easily assembled on a printed circuit board, the present invention is proposed.

The main object of the present invention is to provide a multiple-pieces dual type BNC connector with all metal shell, enabling the manufacturing of two or more than two sets of dual type BNC connectors to be more practicable so as to make the mass production possible and save the production cost.

Another object of the present invention is to provide a multiple-pieces dual type BNC connector with all metal shell, enabling a better insulation effect to be existed between a metal cover and lead wires.

Still another object of the present invention is to provide a multiple-pieces dual type BNC connector with all metal shell, enabling a positioning to be obtained for the portion of a electric lead wire extended outside of the casing so as to be assembled on the printed circuit board more easily.

Still another object of the present invention is to provide a multiple-pieces dual type BNC connector with all metal shell, enabling a BNC connector to have an automatic circuit function concurrently.

BRIEF DESCRIPTION OF THE DRAWINGS

The present invention can be more fully understood by reference to the following description and accompanying drawings, in which.

DETAILED DESCRIPTION OF THE PREFERRED EMBODIMENTS

Figure 1:
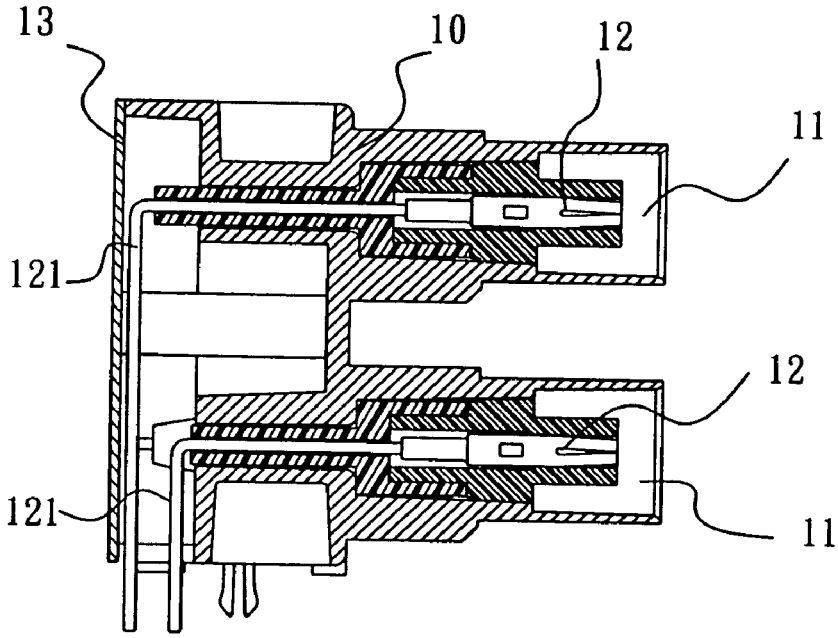
FIG. 1 (PRIOR ART)
FIG. 1 is a cross sectional view, showing a dual type BNC connector with all metal shell of the prior art.
Figure 2:
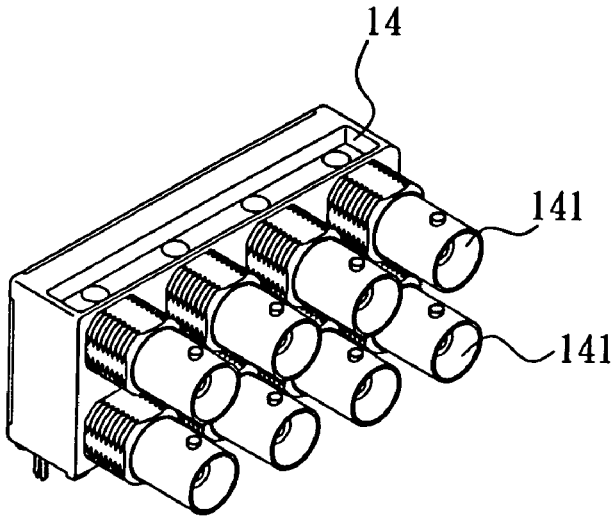
FIG. 2 (PRIOR ART)
FIG. 2 is a prospective view, showing more than two sets of dual type BNC connectors with all metal shell of the prior art.
Figure 3A:
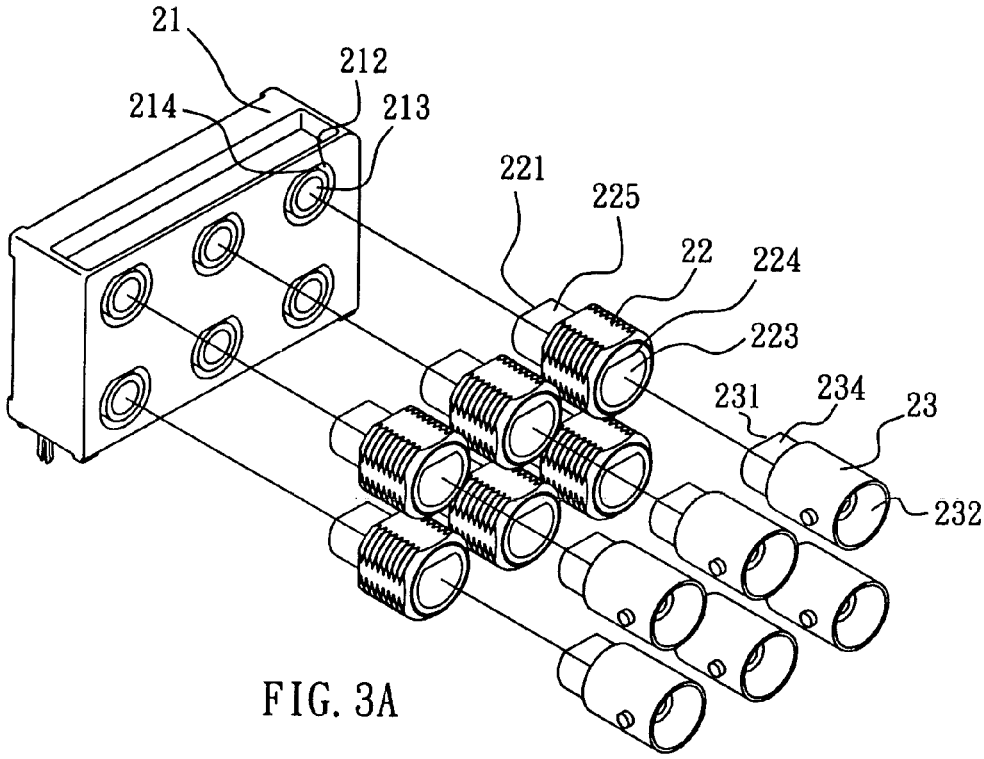
FIGS. 3A and 3B are an explosive view and cross sectional view, showing respectively a BNC connector of a first preferred embodiment according to the present invention.
Figure 3B:
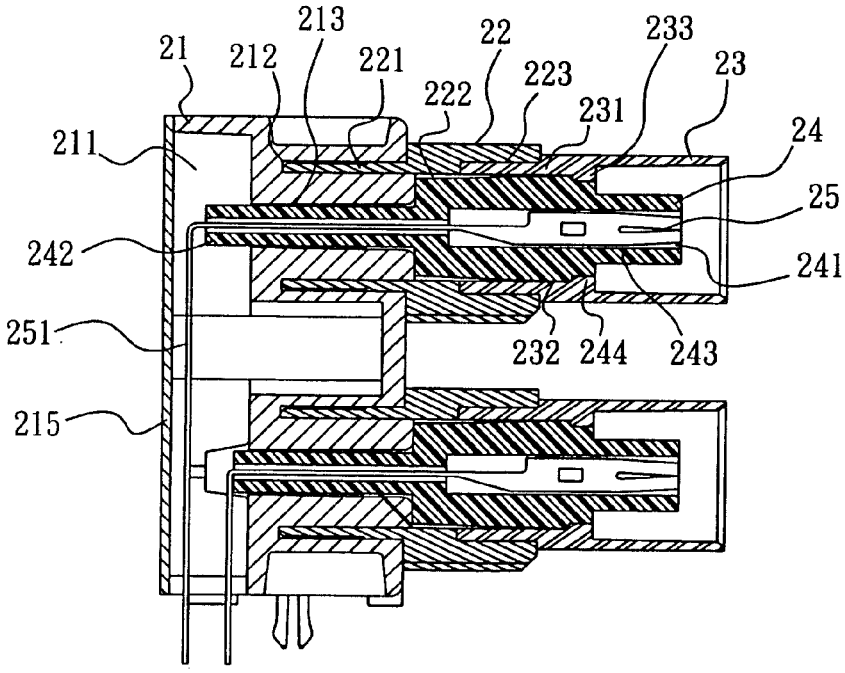

Please refer to FIGS. 3A and 3B. The difference between a multiple-pieces dual type BNC connector with all metal shell of a first preferred embodiment according to the present invention and one-piece type BNC connector with all metal shell mainly is: separating a one-piece type metal shell 10 into a rear section casing 21, a plurality of middle section casings 22 and a front section casing 23. Because every component can be manufactured individually and then combined into a whole body of metal shell, the manufacturing of two sets of more than two sets of dual type BNC connectors is more practicable, and because every component is capable of mass production, the production cost can be reduced.

A rear accepting room 211 is disposed at the rear end of the rear section casing 21 and a plurality of engaging grooves 212 are disposed at the front end thereof. An accepting room 231 passed through the front and rear ends of the rear section casing 21 are disposed within the range of each engaging groove 212. A cut plane 214 is disposed at the engaging groove 212.

An engaging section 221 is disposed at the rear end of the middle section casing 22 and an accepting room 222 is passed through the front and rear ends thereof. A larger aperture of engaging groove 223 is disposed at the front end of the accepting room 222 and a cut plane 224 is disposed at the engaging groove 223. A cut plane 225 corresponding to the cut plane 214 of the engaging groove 212 is disposed at the engaging section 221. The engaging section 221 is engaged in the engaging groove 212 to allow the rear section casing 21 to be connected with the middle section casing 22. Because the two cut planes 214 and 225 are propped against each other, this causes the rear section casing 21 and the middle section casing 22 not to rotate relatively. The aperture of the accepting room 222 is larger than the one of the accepting room 213.

An engaging section 231 is disposed at the rear end of the front section casing 23 and an accepting room 232 is passed through the front and the rear ends thereof. A raised rib ring 233 is disposed in the accepting room 232. A cut plane 234 corresponding to the cut plane 224 in the engaging groove 223 of the middle section casing 22 is disposed at the engaging section 231. The engaging section 231 is engaged in the engaging groove 223 to allow the middle section casing 22 to be combined with the front section casing 23 so that a relative rotation is not yielded between both of them.

A plurality of insulators 24 respectively have an accepting room 241 passed through the both ends at each of them so as to associate with a BNC terminal 25. The insulator 24 has a small aperture section 242 and large aperture section 243, in which the large aperture section 243 has ring groove 244 matched up with the rib ring 233. a thrusting and compelling tightening way is used to cause the small aperture section 242 to be passed through the rear section casing 21 and the large aperture section to be placed in the accepting room 222 of the middle section casing 22 and the accepting room 232 of the rear section casing 23 to engage the ring groove 244 with the rib ring 233 so that the rear sear casing 21, the middle section casings 22, the front end section 23, the insulator 24 and the BNC terminal 25 are combined into one body so as to allow the BNC terminal 25 not to contact with each metal casing. Electric lead wires 215 at the rear end of each BNC terminal 25 are located in the rear accepting room 211 of the rear section casing 21 and bent to extend out of one side of the rear section casing 21. The rear section casing 21 is connected to a metal cover 215 to shield the opening of the rear accepting room 211 to allow the BNC terminal 25 not to be interferenced by outside electromagnetic wave.

Figure 4A:
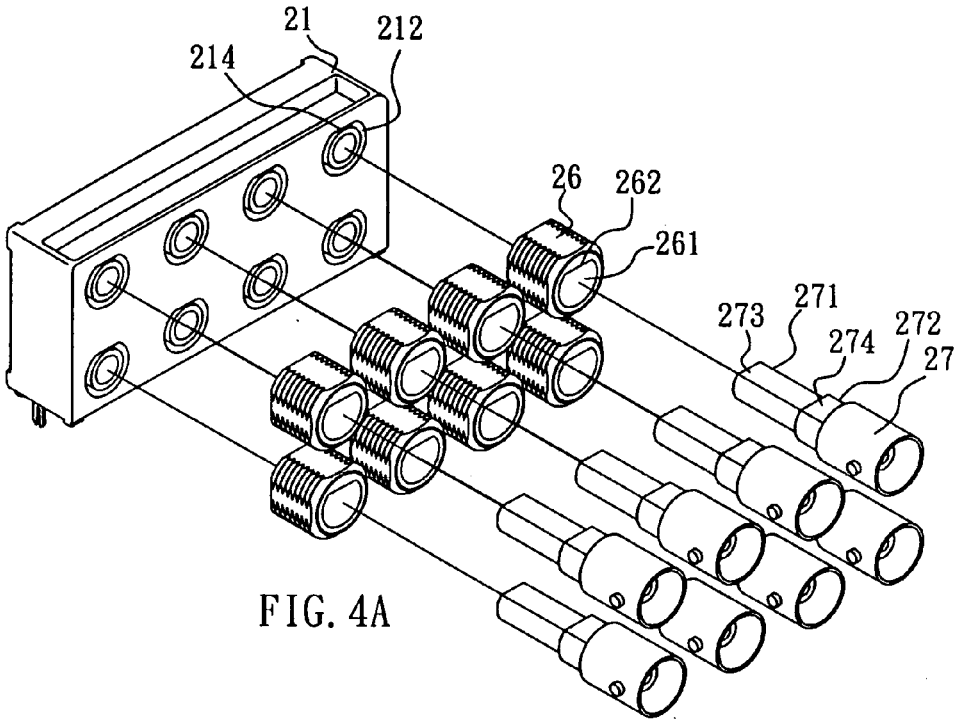
FIGS. 4A and 4B are an explosive view and cross sectional view, showing respectively a BNC connector of a second preferred embodiment according to the present invention.
Figure 4B:
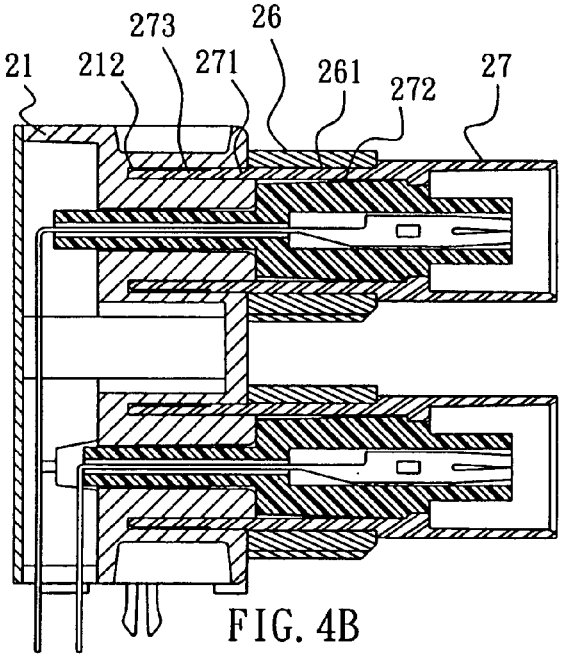

Please refer to FIGS. 4A and 4B. A multiple pieces type dual type BNC connector with all metal shell of a second preferred embodiment according to the present invention also comprises a rear section casing 21, middle section casing 26, front section casing 27, insulator 24 and BNC terminal 25. Except the middle section casing 26 and the front section casing 27 are as different from the middle section casing 22 and the front section casing 23 in the first preferred embodiment mentioned above as FIGS. 3A and 3B, other components are approximately same. In this embodiment, the middle section casing 26 has no engaging section, and the engaging section of front section casing 27 is divided into a first engaging section 271 and second engaging section 272; the two engaging sections respectively have a cut plane 273 and 274. The cut planes 273 and 274 of the first and the second engaging sections 271, 272 are respectively corresponding to the cut plane 214 in an engaging groove 212 of the rear section casing 21 and a cut plane 262 in an engaging groove 261 of the middle section casing 26 to allow no relative rotation to be yielded among the rear section casing 21, the middle section casing 26 and the front section casing 27 after they are engaged.

Figure 5A:
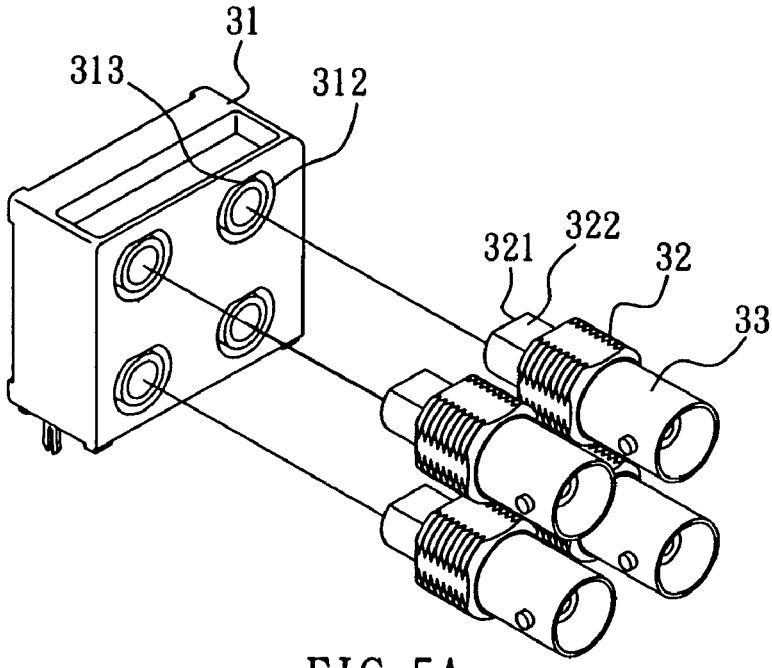
FIGS. 5A and 5B are an explosive view and cross sectional view, showing respectively a BNC connector of a third preferred embodiment according to the present invention.
Figure 5B:
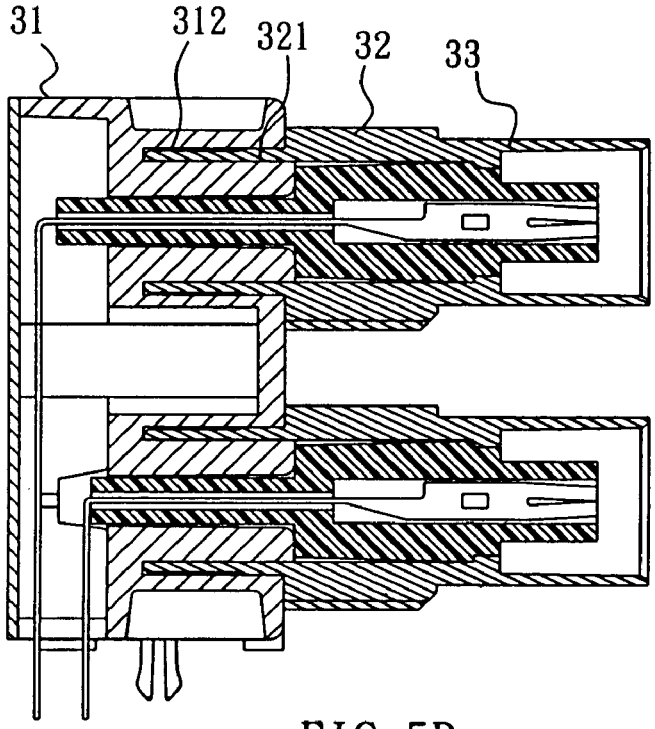

Please refer to FIGS. 5A and 5B. The main difference between a multiple pieces type dual type BNC connector with all metal shell of a third preferred embodiment according to the present invention and the one in the first embodiment shown in FIGS. 3A and 3B lies in that a middle section casing 32 and front section casing 33 are formed into one body. A rear section casing 31 has an engaging groove 312 and a cut plane 313 disposed in the engaging groove 312 is used for accepting an engaging section 321 of a middle section casing 32 and a cut plane 322 thereof.

Figure 6A:
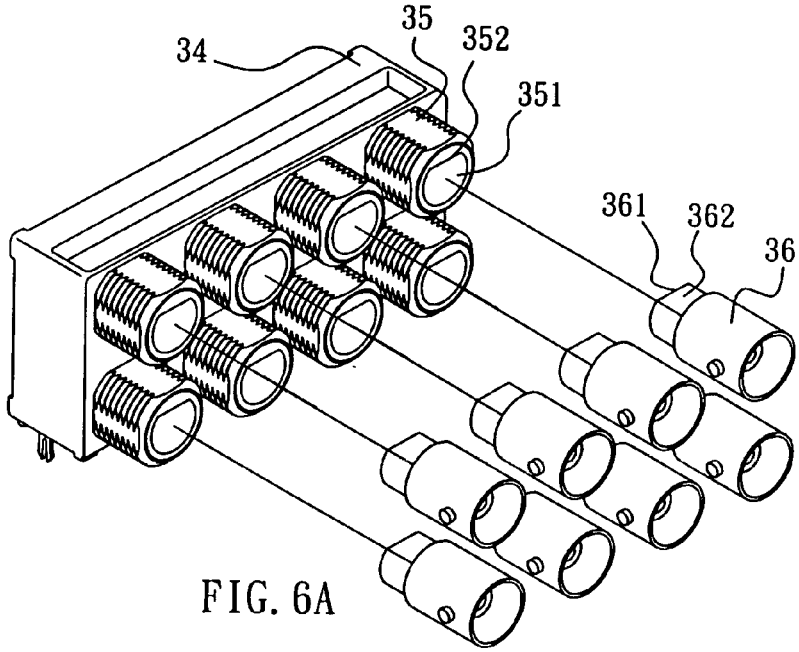
FIGS. 6A and 6B are an explosive view and cross sectional view, showing respectively a BNC connector of a fourth preferred embodiment according to the present invention.
Figure 6B:
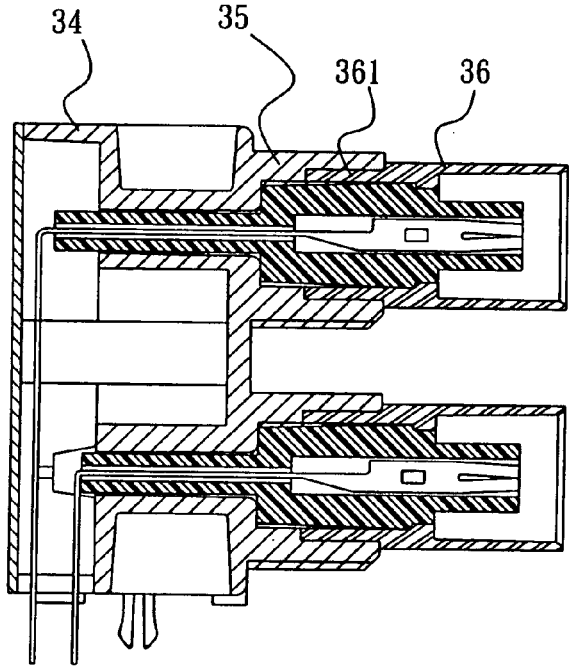

Please refer to FIGS. 6A and 6B. The main difference between a multiple pieces type dual type BNC connector with all metal shell of a fourth preferred embodiment according to the present invention and the one in the first embodiment shown in FIGS. 3A and 3B lies in that a rear section casing 34 and middle section casing 35 are formed into one body. An engaging section 361 of a front section casing 36 and a cut plane 362 thereof are engaged in an engaging groove 351 and a cut plane 352 thereof for allowing the front section casing 36 and the middle section casing 35 to be engaged with each other and not to be rotated relatively.

Figure 7:
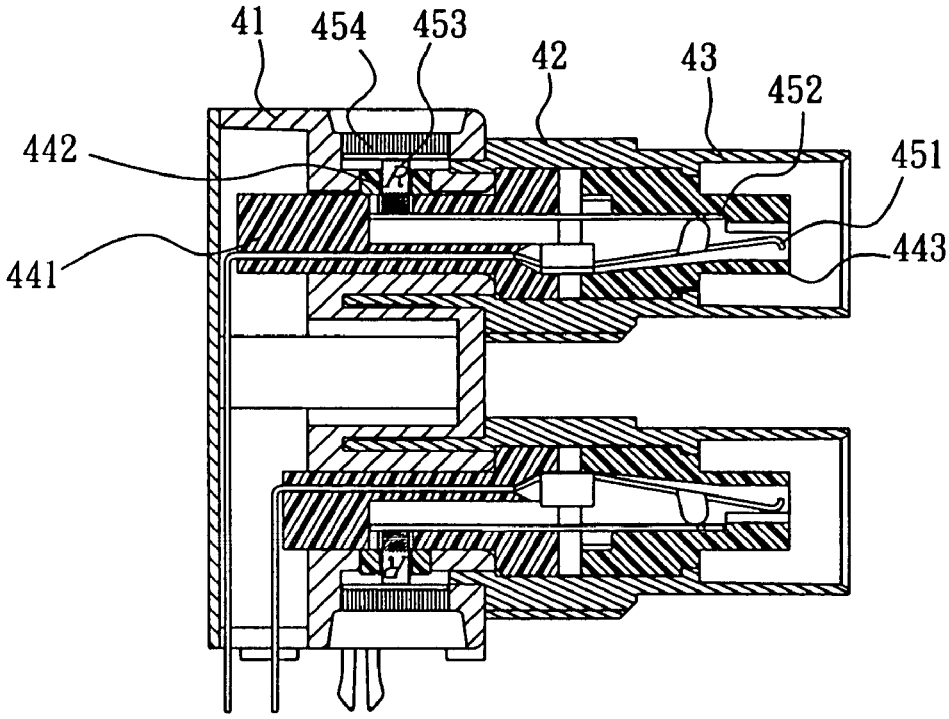
FIG. 7 is a cross sectional view, showing a BNC connector of a fifth preferred embodiment according to the present invention.

Please refer to FIG. 7. The main difference between a multiple pieces type dual type BNC connector with all metal shell of a fifth preferred embodiment according to the present invention and the one in the third embodiment shown in FIGS. 5A and 5B lies in that an insulator combined in a rear section casing 41 and a unity formed by a middle section 42 and front section casing 43 is divided into a rear insulator 441, ring insulator 442 and front insulator 443 after they are engaged with each other together, and the insulator mentioned above is allowed to accept a spring plate 451, conductive plate 452 and a resistor 453 of a BNC terminal with automatic circuit function. The two ends of the resistor 453 are respectively connected to the conductive plate 451 and a metal jacket 454. The metal jacket 454 is engaged in the hole of the rear section casing 41 to allow the rear section casing 41, the metal jacket 454, the resistor 453 and the conductive plate 452 to be electrically connected. When a male BNC terminal from outside is not inserted in the BNC connector and the spring plate 451 is electrically connected, the spring plate 451 can automatically electrically be connected with the conductive plate 452 so as to attain to the automatic circuit function.

Figure 8:
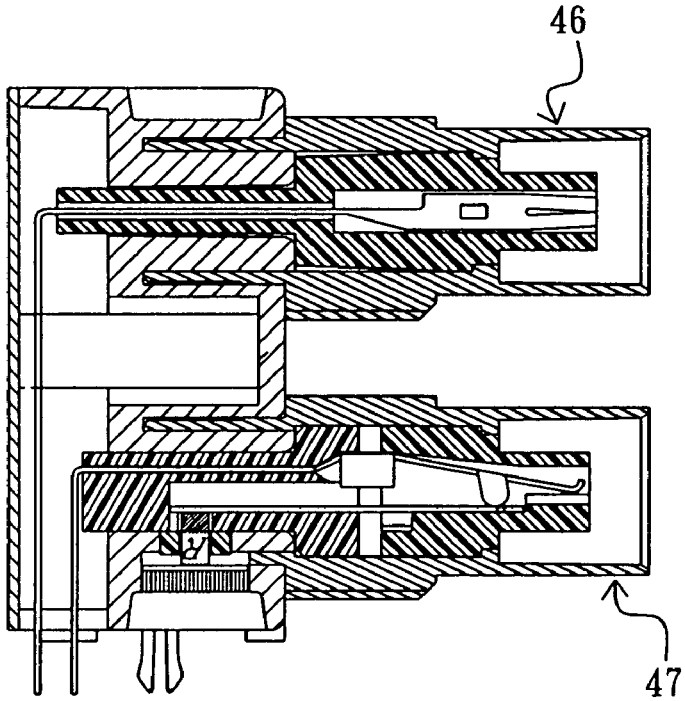
FIG. 8 is a cross sectional view, showing a BNC connector of a sixth preferred embodiment according to the present invention.

Please refer to FIG. 8. The main difference between a sixth preferred embodiment and the fifth preferred embodiment shown in FIG. 7 mentioned above lies in that only one of two BNC connectors 46 and 47 of a dual type BNC connector of this preferred embodiment, i.e. the BNC connector, has a structure of automatic circuit.

Figure 9A:
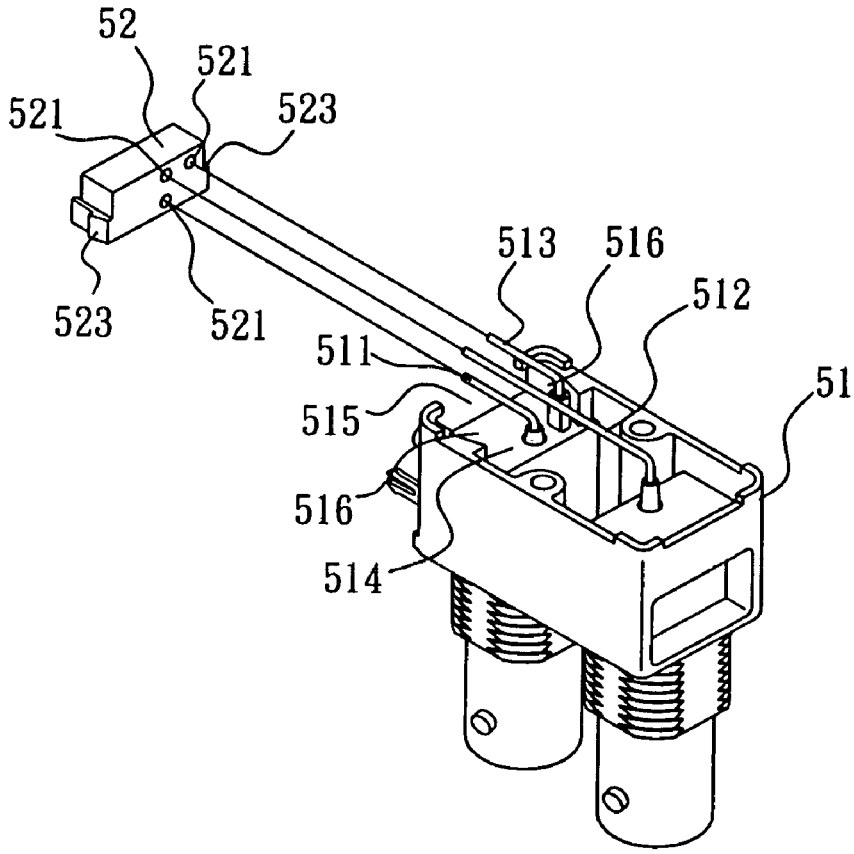
FIGS. 9A and 9B are an explosive view and cross sectional view, showing respectively a BNC connector of a seventh preferred embodiment according to the present invention.
Figure 9B:
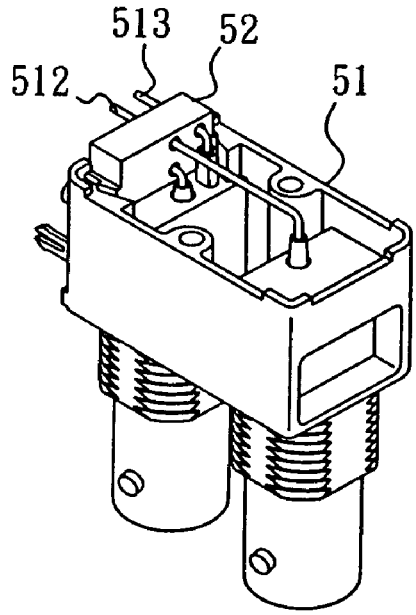

Please refer to FIGS. 9A and 9B. Another characteristic of a multiple pieces BNC connector with all metal shell of a seventh preferred embodiment according to the present invention lies in that after lead wires 511 and 512 extended to the rear end of a BNC terminal outside of a rear section casing 51 and the ground lead wire 513 of the rear section casing 51 are respectively passed through a through hole 521 of a insulating tenon, they are extended to the outside of the rear section casing 51. A notch 515 is disposed at a rear accepting room 514 of the rear section casing 51 and fastening groove 516. Raised masses 523 corresponding to the fastening groove 516 are disposed in the insulating tenon 52. The insulating tenon 52 is engaged at the inside of the notch 515 and the fastening groove 516 is fastened with the raised masses 523 to allow the tenon 52 to be engaged with the rear section casing 51 and allow the lead wires 511 and 512 and ground lead wire 513 extended out of the rear section casing 51 to be positioned by through holes 521 of the insulating tenon 52 so as to be easier to be assembled in a printed circuit board. The insulating tenon 52 is projected out of the rear accepting room 514.

Figure 10A:
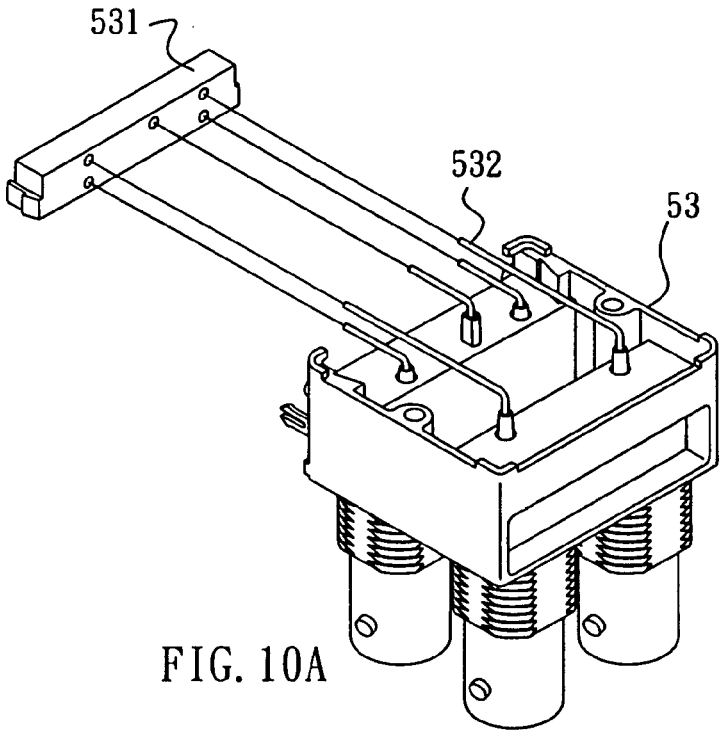
FIGS. 10A and 10B are an explosive view and cross sectional view, showing respectively a BNC connector of a eighth preferred embodiment according to the present invention.
Figure 10B:
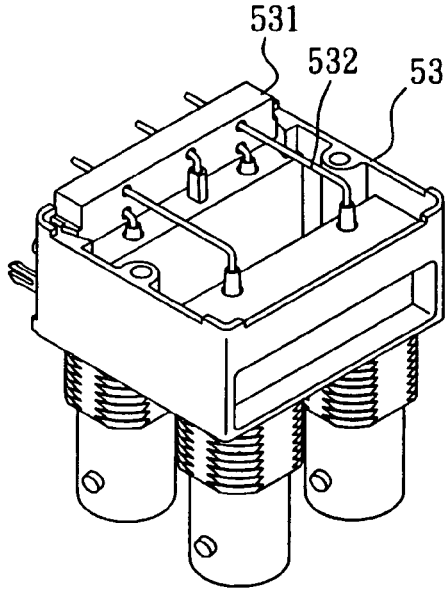

Please refer to FIGS. 10A and 10B. According to an eighth embodiment of the present invention, a rear section casing 53 of two sets multiple pieces type dual type BNC connectors with all metal shell is combined with an insulating tenon 531 to allow a portion of each lead wire 532 projected out the rear section casing 53 to be positioned.

Figure 11A:
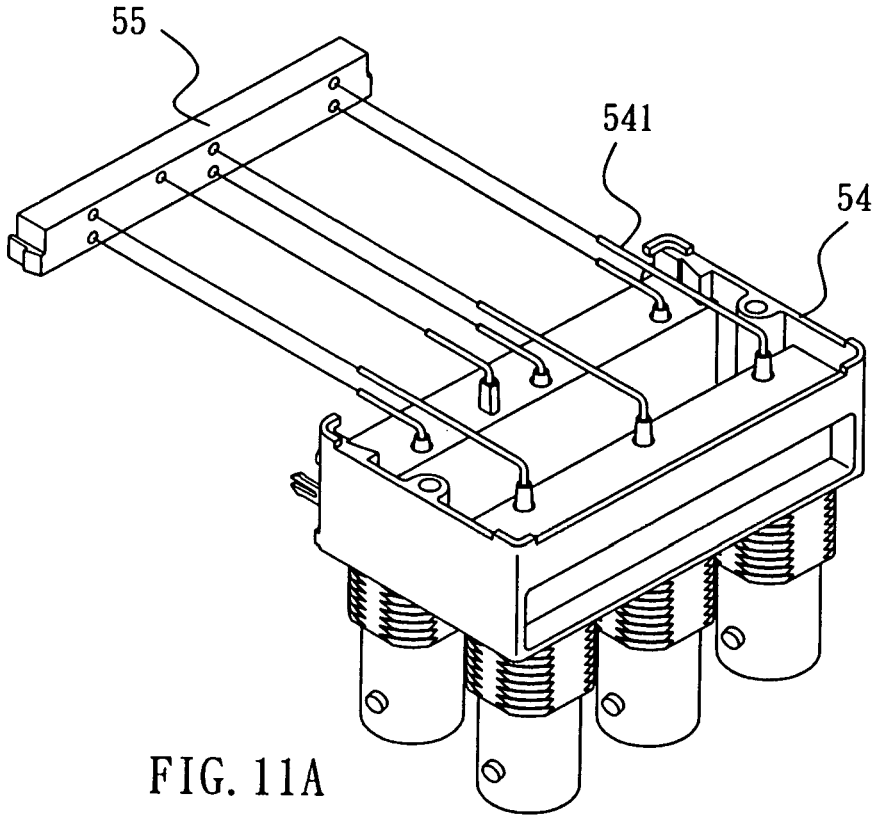
FIGS. 11A and 11B are an explosive view and cross sectional view, showing respectively a BNC connector of a ninth preferred embodiment according to the present invention.
Figure 11B:
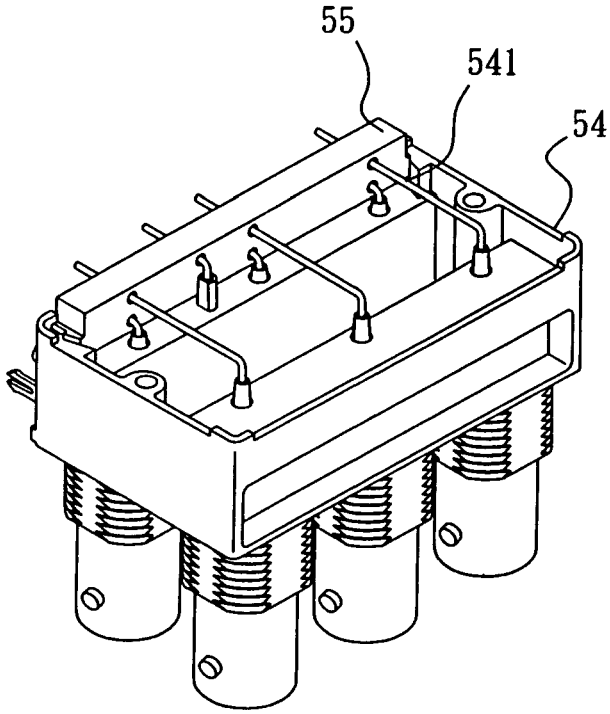

Please refer to FIGS. 11A and 11B. According to an ninth embodiment of the present invention, a rear section casing 54 of three sets multiple pieces type dual type BNC connectors with all metal shell is combined with an insulating tenon 55 to allow a portion of each lead wire 541 projected out the rear section casing 54 to be positioned.

Figure 12A:
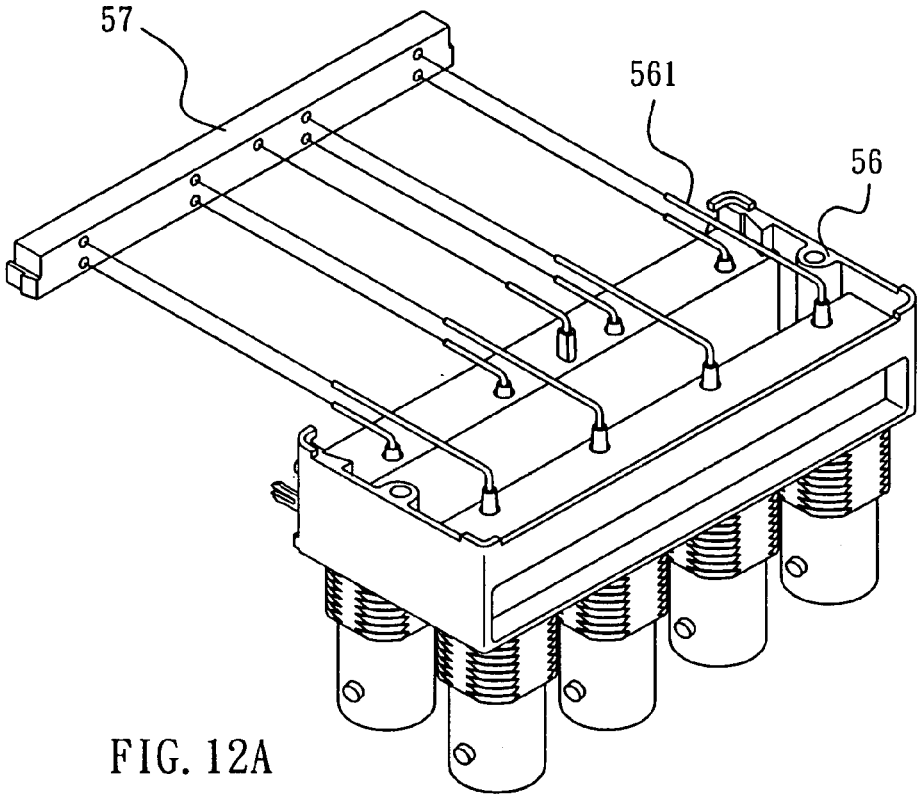
FIGS. 12A and 12B are an explosive view and cross sectional view, showing respectively a BNC connector of a tenth preferred embodiment according to the present invention.
Figure 12B:
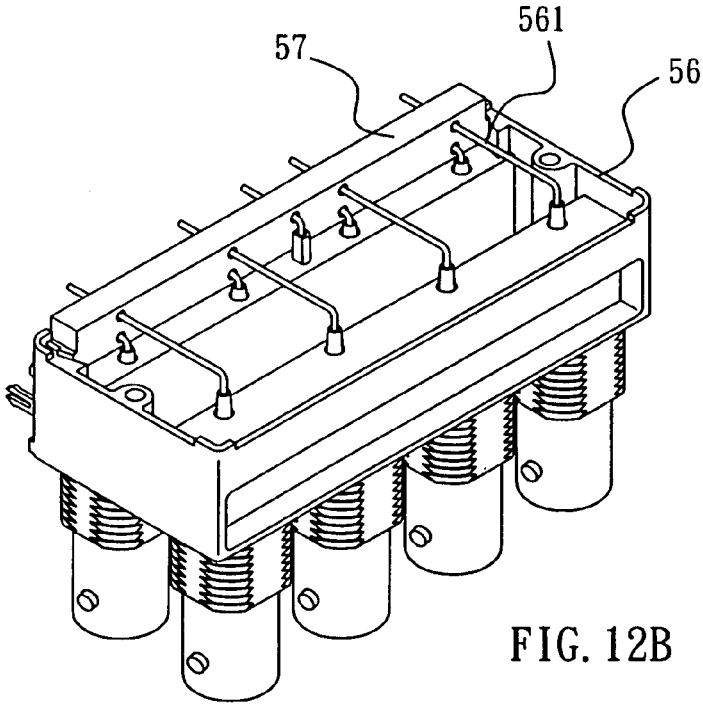
Figure 13A:
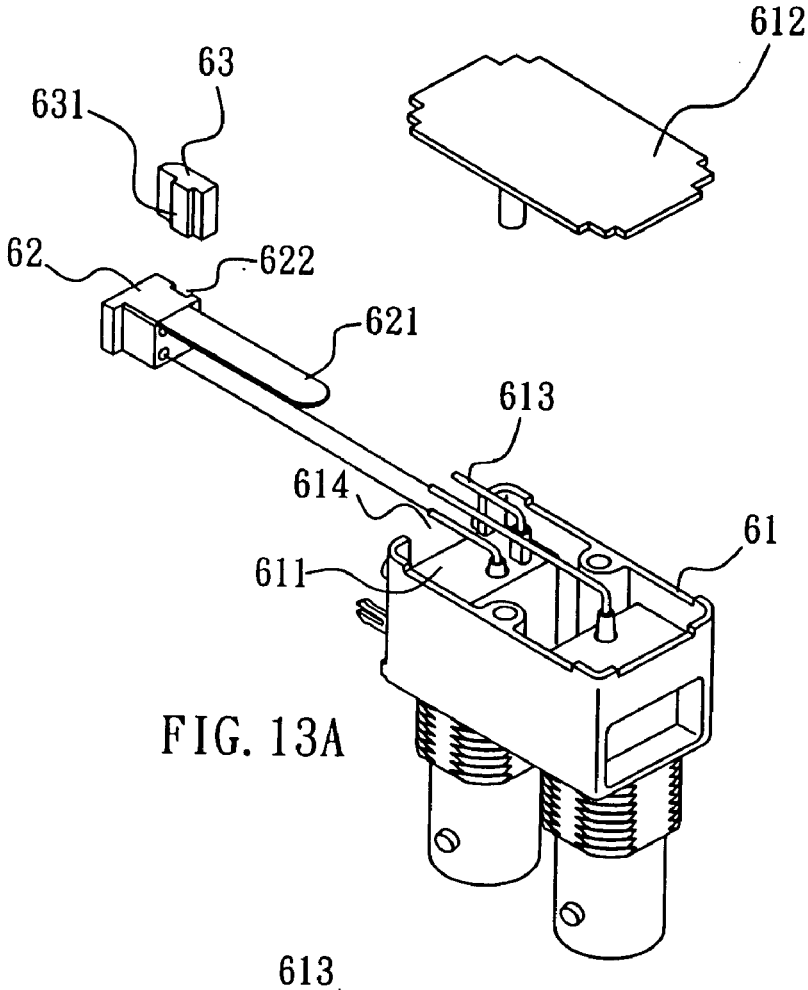
FIGS. 13A and 13B are an explosive view and cross sectional view, showing respectively a BNC connector of a eleventh preferred embodiment according to the present invention.
Figure 13B:
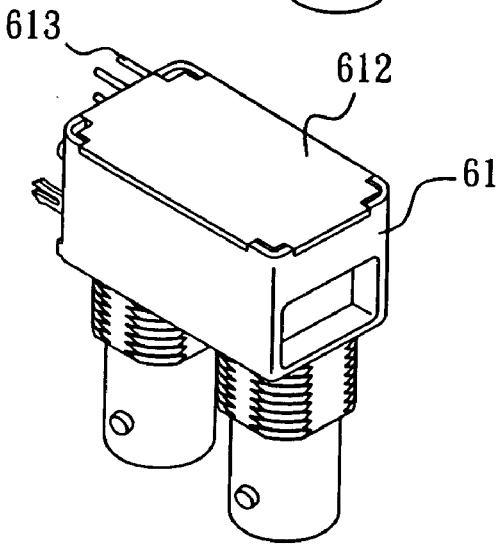

Please refer to FIGS. 12A and 12B. According to an tenth embodiment of the present invention, a rear section casing 56 of four sets multiple pieces type dual type BNC connectors with all metal shell is combined with an insulating tenon 57 to allow a portion of each lead wire 561 projected out the rear section casing 56 to be positioned.

Please refer to 13A and 13B. The difference between an eleventh preferred embodiment according to the present invention and the seventh preferred embodiment shown in FIGS. 9A and 9B lies in that an insulating tenon is divided into a first insulating tenon 62 and a second insulating tenon 63; two thinner tenons can be located in a rear accepting room 611 of a rear section casing 61 to allow the rear section casing to be combined with a metal cover 612 to shield the opening of the rear accepting room 611. The first insulating 62 has a rear end sheet 621. The rear end sheet 621 is larger than the spreading range of lead wires 613 so as to cover all the lead wires 613 to allow the lead wires 613 not to contact with the metal cover 612 to attain to the insulation effect. The first insulating tenon 62 and the second insulating tenon 63 respectively have a corresponding indented groove 622 and projecting rib 631. the first insulating tenon 62 and the second insulating tenon 63 are caused to combined in a notch 614 of the rear accepting room 611 and a portion of each lead wire 613 extended out of the rear section casing 61 is fixed by engaging the indented groove 622 with the projecting rib 631. An insulating paint is not needed to spread on the metal cover 612 to attain to the insulation effect among the lead wires 613 through the design of the rear end sheet 622 used to block the lead wires 613 and the metal cover 612 according to this preferred embodiment. The insulation effect can be enhanced.

Figure 14A:
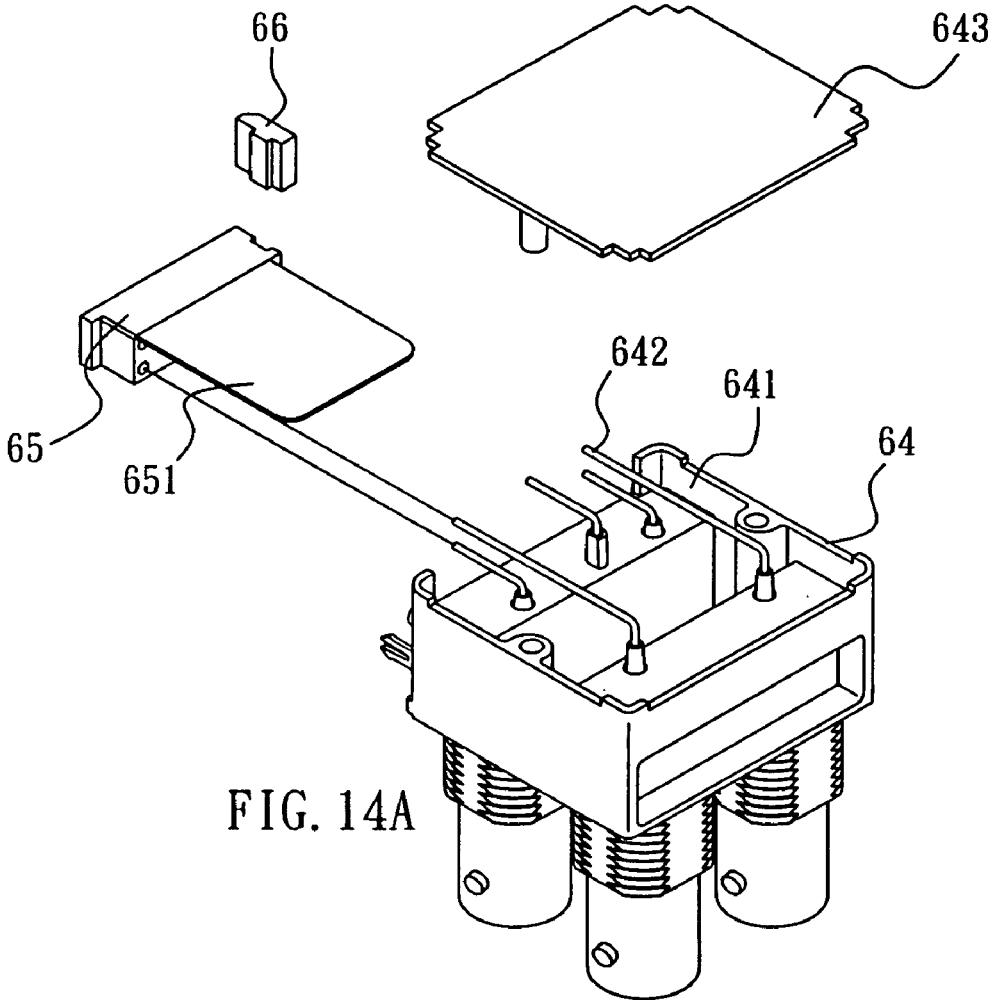
FIGS. 14A and 14B are an explosive view and cross sectional view, showing respectively a BNC connector of a twelfth preferred embodiment according to the present invention.
Figure 14B:
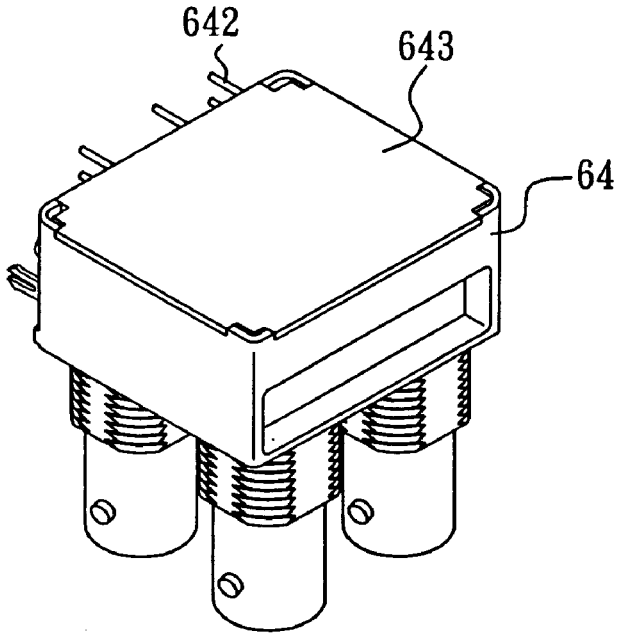

Please refer to FIGS. 14A and 14B. According to a twelfth preferred embodiment of the present invention, a rear accepting room 641 of a rear section casing 64 of two sets of multiple pieces type dual type BNC connectors with all metal shell is combined with a first insulating tenon 65 and second insulating tenon 66. The first insulating tenon 65 has a rear end sheet 651 for covering lead wires 642 to prevent them from contacting with the metal cover 643 so as to attain to the insulation effect. The metal cover 643 is combined with the rear section casing 64 to shield the opening of the rear accepting room 641.

Figure 15A:
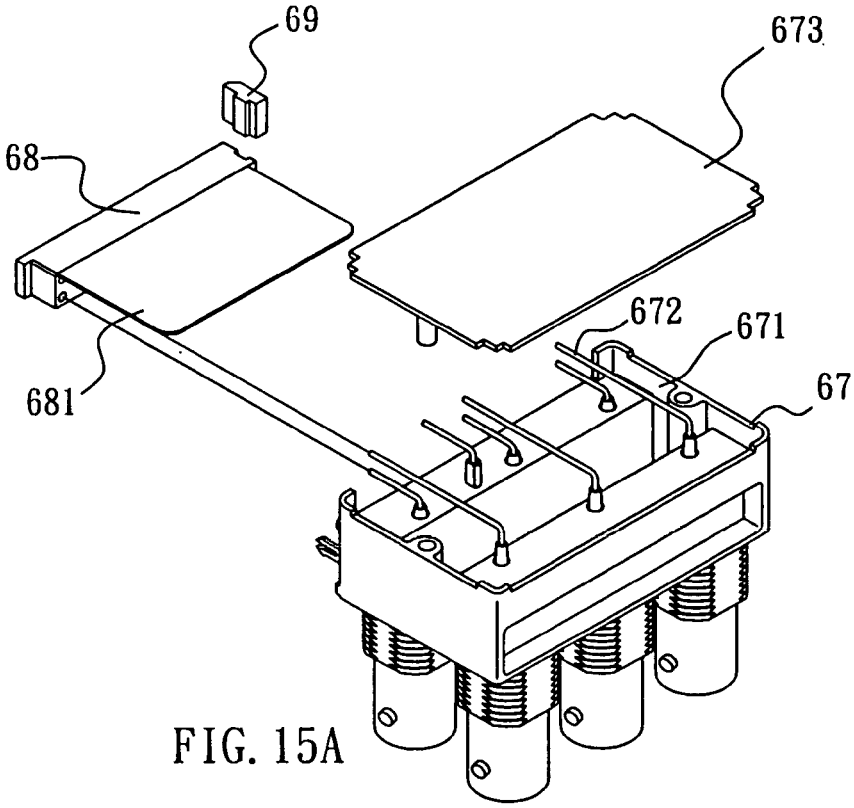
FIGS. 15A and 15B are an explosive view and cross sectional view, showing respectively a BNC connector of a thirteenth preferred embodiment according to the present invention.
Figure 15B:
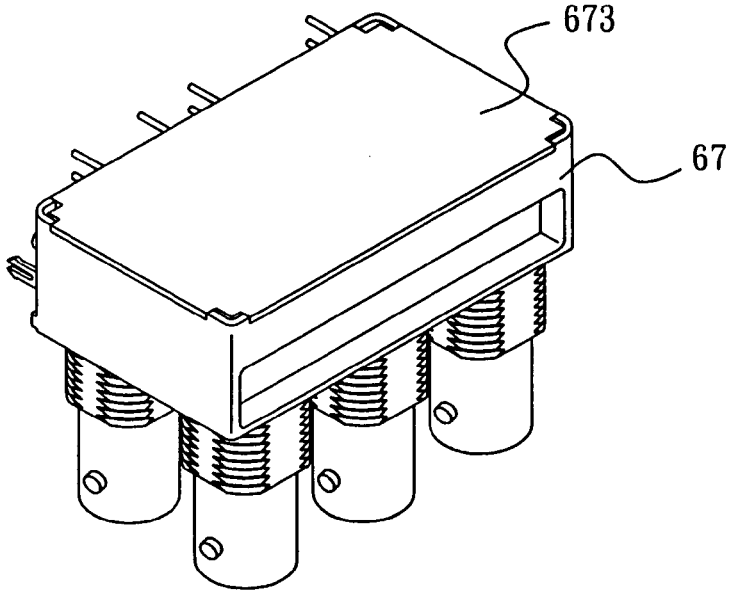

Please refer to FIGS. 15A and 15B. According to a thirteenth preferred embodiment of the present invention, a rear accepting room 671 of a rear section casing 67 of three sets of multiple pieces type dual type BNC connectors with all metal shell is combined with a first insulating tenon 68 and second insulating tenon 69. The first insulating tenon 68 has a rear end sheet 681 for covering lead wires 672 to prevent them from contacting with the metal cover 673 so as to attain to the insulation effect. The metal cover 673 is combined with the rear section casing 67 to shield the opening of the rear accepting room 671.

Figure 16A:
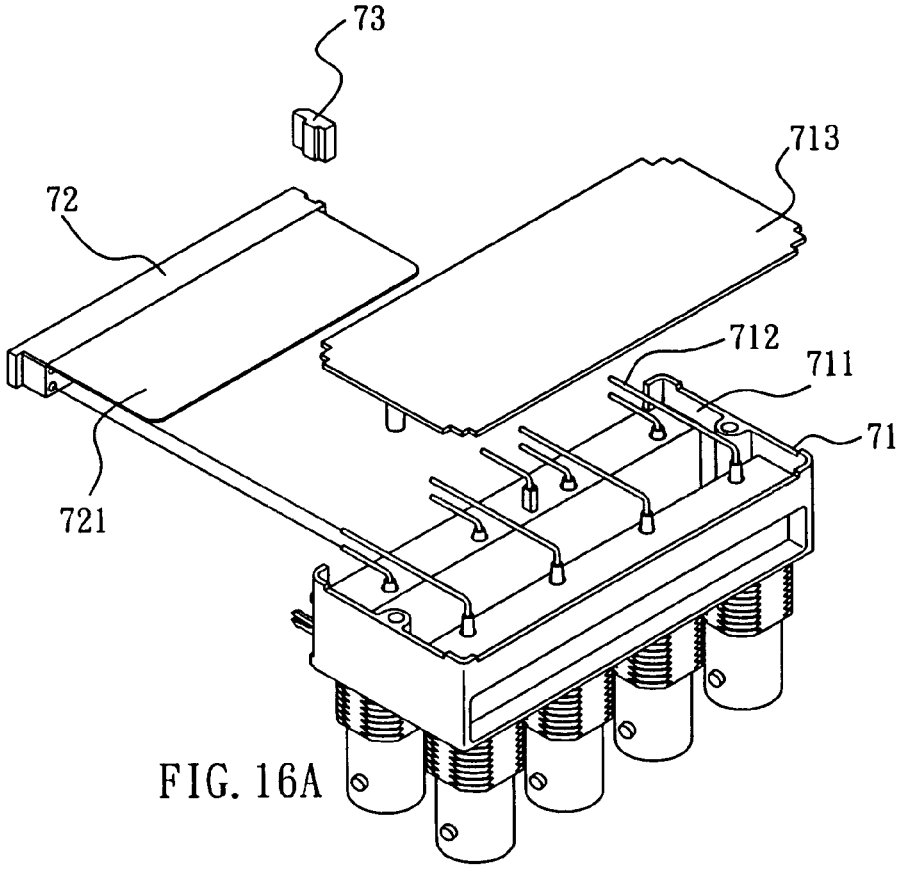
FIGS. 16A and 16B are an explosive view and cross sectional view, showing respectively a BNC connector of a fourteenth preferred embodiment according to the present invention.
Figure 16B:
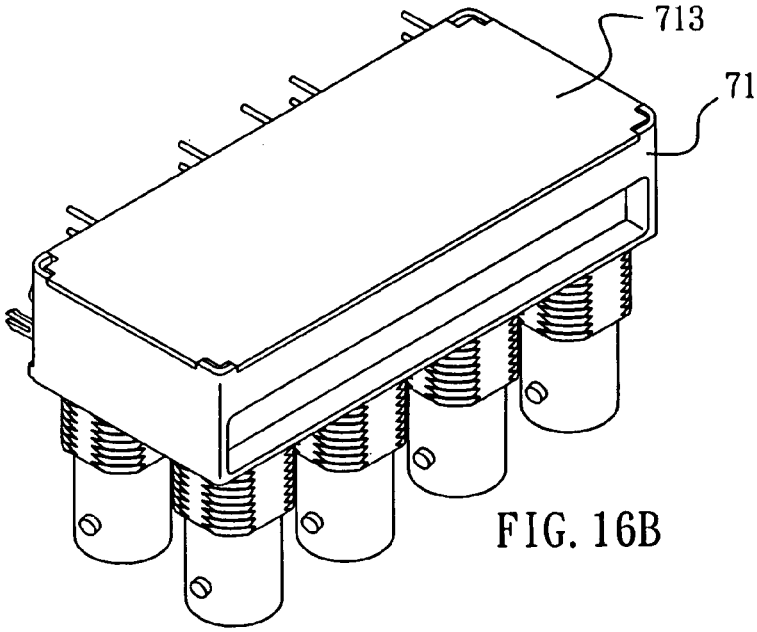

Please refer to FIGS. 16A and 16B. According to a fourteenth preferred embodiment of the present invention, a rear accepting room 711 of a rear section casing 71 of four sets of multiple pieces type dual type BNC connectors with all metal shell is combined with a first insulating tenon 72 and second insulating tenon 73. The first insulating tenon 72 has a rear end sheet 721 for covering lead wires 712 to prevent them from contacting with the metal cover 713 so as to attain to the insulation effect. The metal cover 713 is combined with the rear section casing 71 to shield the opening of the rear accepting room 711.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. A multiple pieces double type BNC connector with an all metal shell, comprising a metalwork rear section casing connected with a plurality of metalwork middle section casings, each said middle section casing being combined with a metalwork front section casing, an accepting room formed by each said front section casing, said middle section casing combined therewith and said rear section casing being combined with a insulator, said insulator being combined with a BNC terminal, said BNC terminal not being contacted with said three metalwork casings, in which at least one of said rear section casing and said front section casing has a combining groove, at least one of said middle section casing and said front section casing has a combining section, said combining section is engaged in said combining groove, wherein a rear accepting room is disposed at the rear end of said rear section casing, said rear accepting room has a notch, said rear accepting room is combined with an insulating tenon to shield said notch; said insulating tenon has a plurality of through holes, a plurality of lead wires at the rear end of said BNC terminal and a ground lead wire of said rear section casing are respectively accepted in said through holes; whereby, the portions of said lead wires passed through out said through holes are allowed to position, wherein said rear section casing is connected to a metal cover for shielding the opening of said accepting room; said insulating tenon has a rear end sheet, said rear end sheet is covered between said lead wires and said metal cover so as to cause said lead wires and said metal cover not to touch each other to attain to the insulation effect.

2. The dual type BNC connector according to claim 1, wherein a rear accepting room is disposed at the rear end of said rear section casing, said rear section casing is combine a metal cover to shield the opening of said rear accepting room.

3. The dual type BNC connector according to claim 1, wherein two corresponding cut planes are respectively disposed at said combining groove and said combining section so as to cause no relative rotation to be yielded between both of them.

4. The dual type BNC connector according to claim 1, wherein said insulator in at least one body of BNC connector in said dual type BNC connector is divided into a rear insulator, ring insulator and front insulator; said BNC terminal is a BNC connector with automatic circuit function comprising a spring plate, conductive plate and resistor; said conductive plate and a metal jacket are respectively electrically connected to the two ends of said resistor, said metal jacket is engaged in a hole of said rear section casing so as to allow said rear section casing, said metal jacket, said resistor and said conductive plate to be electrically connected, said spring plate is automatically electrically connected to said conductive plate to attain to the automatic circuit function when outside male BNC terminal is inserted into said BNC terminal and electrically connected to said spring plate.

5. The dual type BNC connector according to claim 1, wherein combining grooves are respectively disposed in said rear section casing and said middle section casing and combining sections are respectively disposed at said middle section casing and said front section casing.

6. The dual type BNC connector according to claim 1, wherein both of said rear section casing and said middle section casing all have a combining groove, said front section casing has a combining section, said combining section is divided into a first combining section and second combining section, said first combining section and said second combining section are respectively engaged in said combining grooves of said rear section casing and said middle section casing.

7. The dual type BNC connector according to claim 1, wherein said rear section casing has a combining groove and said middle section casing has a combining section, said middle casing and said front section casing are formed into one body.

8. The dual type BNC connector according to claim 1, wherein said middle section casing has a combining groove and said front section casing has a combining section, said middle casing and said rear section casing are formed into one body.

9. The dual type BNC connector according to claim 1, wherein said rear section casing is connected to at least four middle section casings.

10. The dual type BNC connector according to claim 1, wherein said rear section casing is connected to at least six middle section casings.

11. The dual type BNC connector according to claim 1, wherein said rear section casing is connected to at least eight middle section casings.

12. The dual type BNC connector according to claim 1, wherein a fastening groove is disposed inside of said notch of said rear accepting room, said insulating tenon has a raised mass corresponding to said fastening groove, said fastening groove is engaged with said raised mass.

13. The dual type BNC connector according to claim 1, wherein said insulating tenon is projected out to the outside of said rear accepting room.

14. The dual type BNC connector according to claim 1, wherein said insulating tenon comprising a first insulating tenon and second insulating tenon, said first insulating tenon and said second insulating tenon respectively have a corresponding indented groove and projecting rib, said indented groove is engaged with said projecting rib.

15. The dual type BNC connector according to claim 14, wherein said first insulating tenon has said rear end sheet.

* * * * *